US009644479B2

(12) United States Patent
Garcia et al.

(10) Patent No.: US 9,644,479 B2
(45) Date of Patent: May 9, 2017

(54) DEVICE FOR SAMPLING FLUID UNDER PRESSURE FOR GEOLOGICAL SITE DEVELOPMENT MONITORING

(71) Applicant: IFP ENERGIES NOUVELLES, Rueil-Malmaison (FR)

(72) Inventors: Bruno Garcia, Rueil-Malmaison (FR); Miguel Garcia, Saint-Germain-en-Laye (FR); Claudio Fernandes-Marto, Poissy (FR); Virgile Rouchon, Vaucresson (FR)

(73) Assignee: IFP ENERGIES NOUVELLES, Rueil-Malmaison (FR)

( * ) Notice: Subject to any disclaimer, the term of this patent is extended or adjusted under 35 U.S.C. 154(b) by 100 days.

(21) Appl. No.: 14/649,927

(22) PCT Filed: Oct. 31, 2013

(86) PCT No.: PCT/FR2013/052614

§ 371 (c)(1),
(2) Date: Jun. 5, 2015

(87) PCT Pub. No.: WO2014/087061

PCT Pub. Date: Jun. 12, 2014

(65) Prior Publication Data

US 2015/0315908 A1 Nov. 5, 2015

(30) Foreign Application Priority Data

Dec. 7, 2012 (FR) ..... 12 03329

(51) Int. Cl.
*E21B 49/08* (2006.01)

(52) U.S. Cl.
CPC ..... *E21B 49/088* (2013.01); *E21B 49/081* (2013.01)

(58) Field of Classification Search
CPC ..... E21B 49/08; E21B 49/088; E21B 49/081; E21B 49/00
See application file for complete search history.

(56) References Cited

U.S. PATENT DOCUMENTS 3,095,930 A 7/1963 Kisling, III
3,422,896 A * 1/1969 Nutter ..... E21B 49/081 166/113

(Continued)

FOREIGN PATENT DOCUMENTS

FR 2972758 A1 9/2012
FR 2974358 A1 10/2012
GB 2252296 A 8/1992

OTHER PUBLICATIONS

International Search Report for International Application No. PCT/FR2013/0526123 dated Jan. 27, 2014 with English translation.

*Primary Examiner* — Nguyen Ha
(74) *Attorney, Agent, or Firm* — Fitch, Even, Tabin & Flannery LLP

(57) ABSTRACT

The invention is a device for sampling fluids under pressure from a well which comprises a chamber for retaining the fluid within a sample chamber (01). The chambers includes a first piston which allows or prevents fluid inflow into the lower part of the chamber. The first piston is displaced by means comprising an elastic element (20) disposed in a chamber filled with oil and connected to the piston by a rod (04). Sampled fluid transfer means allows control of the descent of a second piston (02) from the upper part to the lower part of the chamber so that the fluid remains at constant pressure in chamber during the transfer.

34 Claims, 10 Drawing Sheets

(56) References Cited

U.S. PATENT DOCUMENTS

| | | | | |
|---|---|---|---|---|
| 3,448,611 | A * | 6/1969 | Lebourg | E21B 49/081 166/264 |
| 5,896,926 | A | 4/1999 | Hama et al. | |
| 5,945,611 | A | 8/1999 | Welker | |
| 2015/0153073 | A2* | 6/2015 | Pelletier | E21B 49/081 126/600 |

* cited by examiner

DEVICE FOR SAMPLING FLUID UNDER PRESSURE FOR GEOLOGICAL SITE DEVELOPMENT MONITORING

CROSS REFERENCE TO RELATED APPLICATIONS

Reference is made to PCT Patent Application No. 2013/052614, filed on Jun. 12, 2014, and French Patent Application No. 12/03.329, filed on Dec. 7, 2012, which applications are incorporated herein by reference in their entirety.

BACKGROUND OF THE INVENTION

Field of the Invention

The invention relates to the technical field of underground medium development, such as gas reservoir development (gas storage/withdrawal, gas exploitation) and monitoring of these operations (contamination of operations on aquifers). The invention notably relates to the field of geological storage site monitoring for gases such as carbon dioxide ($CO_2$) or methane. In particular, the invention relates to fluid sampling devices and more particularly to a device for sampling fluids under pressure in a well, a pipe, a tube, a conduit or the like.

Description of the Prior Art

Fluids present in wells often need to be sampled in order to determine their composition to characterize the geological reservoirs reached by the borehole. This is notably the case for geological gas storage site monitoring.

Industrialists have developed many techniques allowing the evolution of fluids injected into porous media to be monitored.

Geochemical monitoring methods for geological $CO_2$ storage sites, based on the study of volatile species, are for example known. These methods are described in French Patent Nos. 2,972,758 and 2,974,358.

These methods essentially apply to two compartments which are reservoirs/saline aquifers where the main objective is to quantify the dissolved and precipitated $CO_2$, and thus to establish a real mass balance, and aquifers overlying the cap rock, where the main objective is to diagnose a leak as early as possible.

To implement these methods, it is thus necessary to have a device for sampling fluids under pressure in a well drilled through a geological formation. Such a device is referred to as sampler.

Samplers known as FTS (Flow-Through Sampler), allow obtaining fluid samples from a well drilled through a geological formation. Such a device is comprised of a sample chamber with a spring-loaded valve at each end. A latching mechanism connects the valves together and holds them open. A clock for programming the closing time and a triggering mechanism for releasing the valves are arranged above the chamber. The lower end is provided with means allowing the fluid to enter. A rope socket for attaching a cable is arranged at the top.

U.S. Pat. No. 5,945,611 discloses a device for sampling fluids under pressure in a pipe, a tube, a conduit or the like. This device comprises a plurality of pistons, a body having a common passageway, wherein the pistons are slidably mounted and a lateral inlet and a lateral outlet port are located within the passageway and communicate with the pipeline. The inlet and outlet ports are arranged so that the motion of the pistons covers and uncovers the inlet and outlet ports.

U.S. Pat. No. 5,896,926 discloses a device for in-situ sampling of groundwater under static conditions without disturbing the environment which comprises a packer to isolate the sampling system from the area located above, as well as an in-situ pumping system in the sampler for "sucking" the fluid into the sample chamber.

SUMMARY OF THE INVENTION

The invention relates to a device for sampling fluids under pressure from a well which allows a fluid under pressure to be sampled by providing complete filling of a sample chamber, and fluid transfer out of the chamber while controlling the pressure.

The invention comprises, on the one hand, a piston controlled by a spring immersed in an oil chamber for sampling the fluid and, on the other hand, a second piston for expelling the fluid upon transfer.

The invention is kept in open or closed position by a compressed spring housed in the oil-filled chamber. The oil contained in the spring chamber allows a decompression effect to be damped and smooth sampling to be achieved.

The invention enables recovery of the sampled fluid using the mechanical action of a solid piston through a manual valve and allows avoiding mercury systems or piston fluid systems and recovery of all or part of the fluid under controlled pressure conditions. Furthermore, the invention avoids using a surge chamber and an oil chamber as in nearly all of the known samplers.

In general terms, the invention relates to a device for sampling fluids under pressure from a well, comprising a sample chamber (01) defining an inner volume intended to receive the fluid, a body (10, 03, 08) above the sample chamber, circulation means for circulating the fluid in the chamber, means for keeping the fluid in the chamber, and means for transferring the fluid out of the chamber. According to the invention:

- the means for keeping comprises a first piston (05) for allowing or preventing fluid inflow into the lower part of chamber (01). The first piston is displaced by an elastic element (20) arranged in a chamber filled with oil;
- the means for transferring comprises means for controlling descent of a second piston (02) from the upper part to the lower part of the chamber, so that the fluid remains at constant pressure in chamber (01).

According to the invention, the first piston (05) can be connected to elastic element (20) by a rectilinear element (04, 07) in such a way that, when elastic element (20) is compressed, the rectilinear element drives first piston (05) out of sample chamber (01), thus allowing a fluid into sample chamber (01). When elastic element (20) is relaxed, the rectilinear element cooperates with second piston (02) to tightly close sample chamber (01) in the upper part thereof, and the rectilinear element drives first piston (05) upwards so as to tightly close sample chamber (01) in the lower part thereof.

According to one embodiment, the rectilinear element comprises a rod (04), a second piston (02) provided with a central port, which allows an upper part of rod (04) to slide and provides a sealed closing with a lower part of rod (04) with the diameter of the lower part of rod (04) being larger than that of the upper part.

Sample chamber (01) can be closed in the lower part thereof by an end piece (06) provided with at least a first port (28) and having a length enabling first piston (05) to allow passage of a fluid into sample chamber (01) via the first port when elastic element (20) is compressed.

According to the invention, the circulation means can comprise at least a second port (29) allowing fluid to flow out from the upper part of the chamber and at least a first port (28) on end piece (06).

Body (10, 03, 08) can comprise at least one tube (10, 03, 08) including an elastic element (20) and means (07, 22, 09, 23) for relaxing or compressing elastic element (20).

The means (07, 22, 09, 23) for relaxing or compressing elastic element (20) can comprise a split collet (09) slidingly mounted in body (10, 03, 08) and cooperating with a handle (23) for compressing or releasing elastic element (20).

The means (07, 22, 09, 23) for relaxing or compressing elastic element (20) can be connected to an electric motor or to a clock (24).

The electric motor or clock (24) can be positioned in a tube (11) comprising a needle valve (26) and a high-pressure connection for filling the chamber of elastic element (20) with oil.

Elastic element (20) can be a spring or a set of Belleville washers.

According to the invention, a transfer piston (12) can be mounted to push second piston (02) with the transfer piston (12) being hollow adapted so that rod (04) slides within.

End piece (06) can be removed from the sample chamber (01) and replaced by an end piece (13) without a port allowing the first piston (05) to be kept within the chamber.

Finally, according to the invention, the first piston (05) can be equipped with a needle valve (25) and with a high-pressure connection allowing the fluid to be discharged from sample chamber (01).

The invention also relates to a use of the device according to the invention wherein the development of an underground geological site is monitored by sampling fluid under pressure using a monitoring well, characterized in that the following stages are carried out:

- actuating the handle to compress the elastic element;
- lowering the device, in an "open" position, into the monitoring well, using a cable attached to the upper part of the device;
- at a predetermined depth, leaving the device in "open" position for a predetermined period of time;
- actuating the handle to release the elastic element so that the device switches into the "closed" position;
- bringing the device back to the surface;
- transferring the fluid out of the chamber of the device by pushing the upper piston while controlling the pressure by use of a pressure detector so that the pressure in the chamber remains constant; and
- performing analyses of the sampled fluid.

The development of an underground geological site can include monitoring a geological $CO_2$ storage site, monitoring a natural gas storage/withdrawal site or monitoring a shale gas development site.

BRIEF DESCRIPTION OF THE DRAWINGS

Other features and advantages of the device according to the invention will be clear from reading the description hereafter of embodiments given by way of non-limitative example, with reference to the accompanying figures wherein.

DETAILED DESCRIPTION OF THE INVENTION

Figure 1:
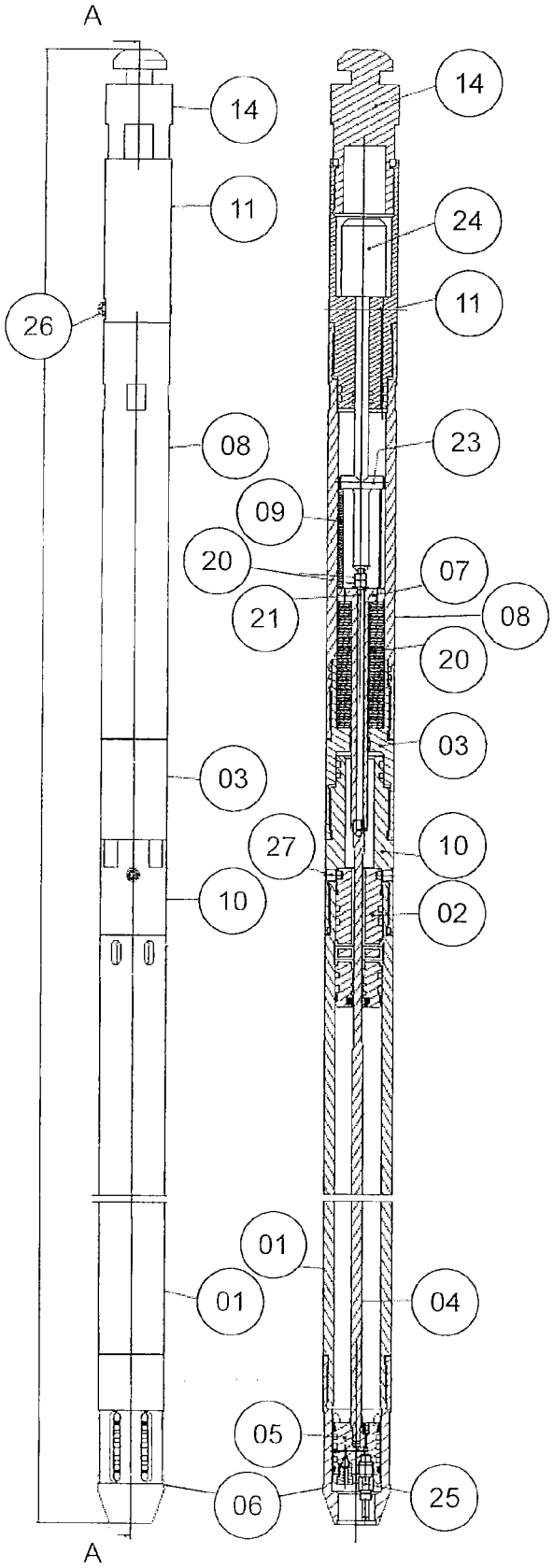
FIG. 1 illustrates the device in "open" position with the right-hand figure being a cross-section along axis A-A of the left-hand figure.

The device according to the invention for sampling fluids under pressure is based on the principle of samplers known as FTS (Flow-Through Sampler) wherein the liquid from the well freely circulates within the device.

FIGS. 1 to 10 illustrate the device according to the invention for sampling fluids under pressure. In these figures, the same reference numbers have been used. The device comprises at least:

1. a sample chamber (01);
2. a body (10, 03, 08) positioned above the sample chamber;
3. circulation means for circulating the fluid in the chamber;
4. means for keeping the fluid in the chamber; and
5. transfer means for transferring the fluid out of the chamber.

According to the invention, the means for keeping comprises a first piston (05) which allows or prevents passage of the fluid into the lower part of the chamber (01), the first piston is displaced by means including an elastic element (20) arranged in an oil-filled chamber within the body and connected to the piston by a rod (04).

The transfer means comprises means for controlling the descent of a second piston (02) from the upper part to the lower part of the chamber, so that the fluid remains at constant pressure in the chamber (01).

Figure 2:
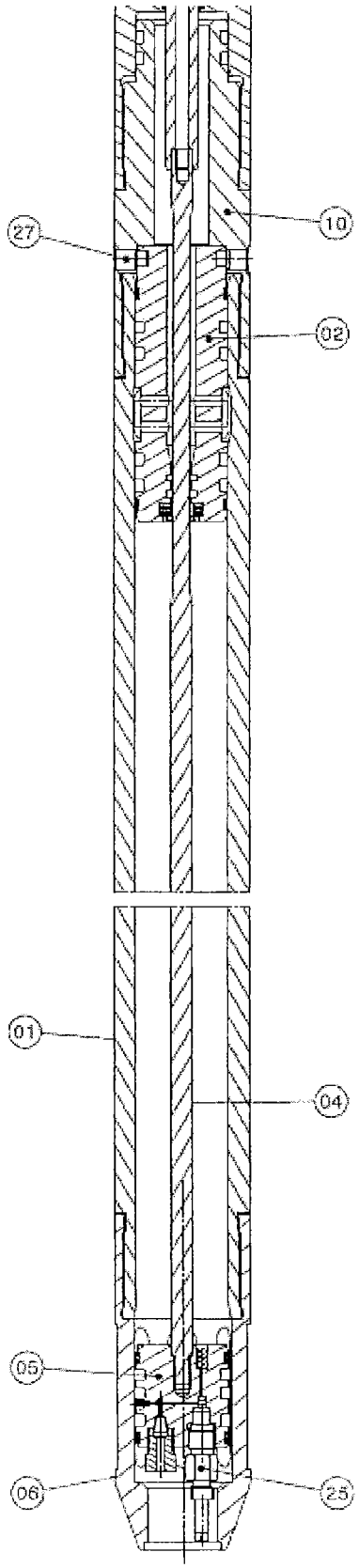
FIG. 2 shows the lower part of the device.
Figure 3:
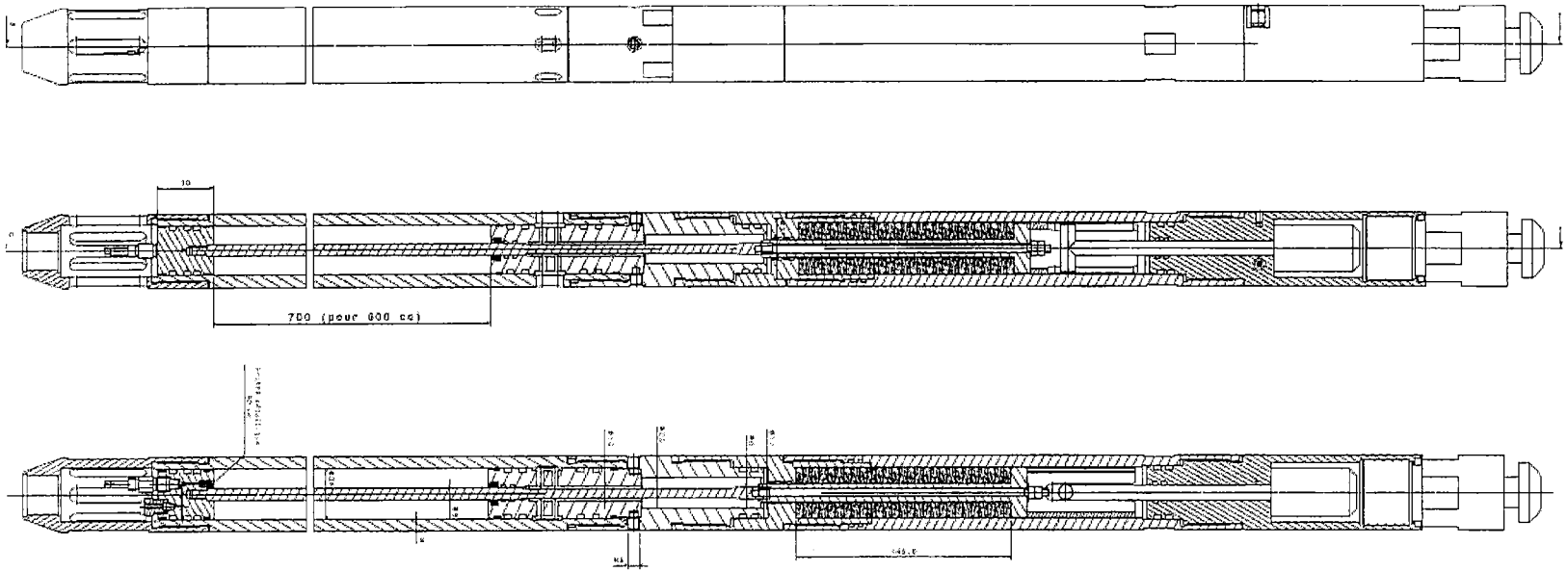
FIG. 3 illustrates the device in "closed" position with the middle figure being a cross-section along axis B-B of the left-hand figure, and the right-hand figure being a cross-section along axis C-C of the middle figure.
Figure 4:
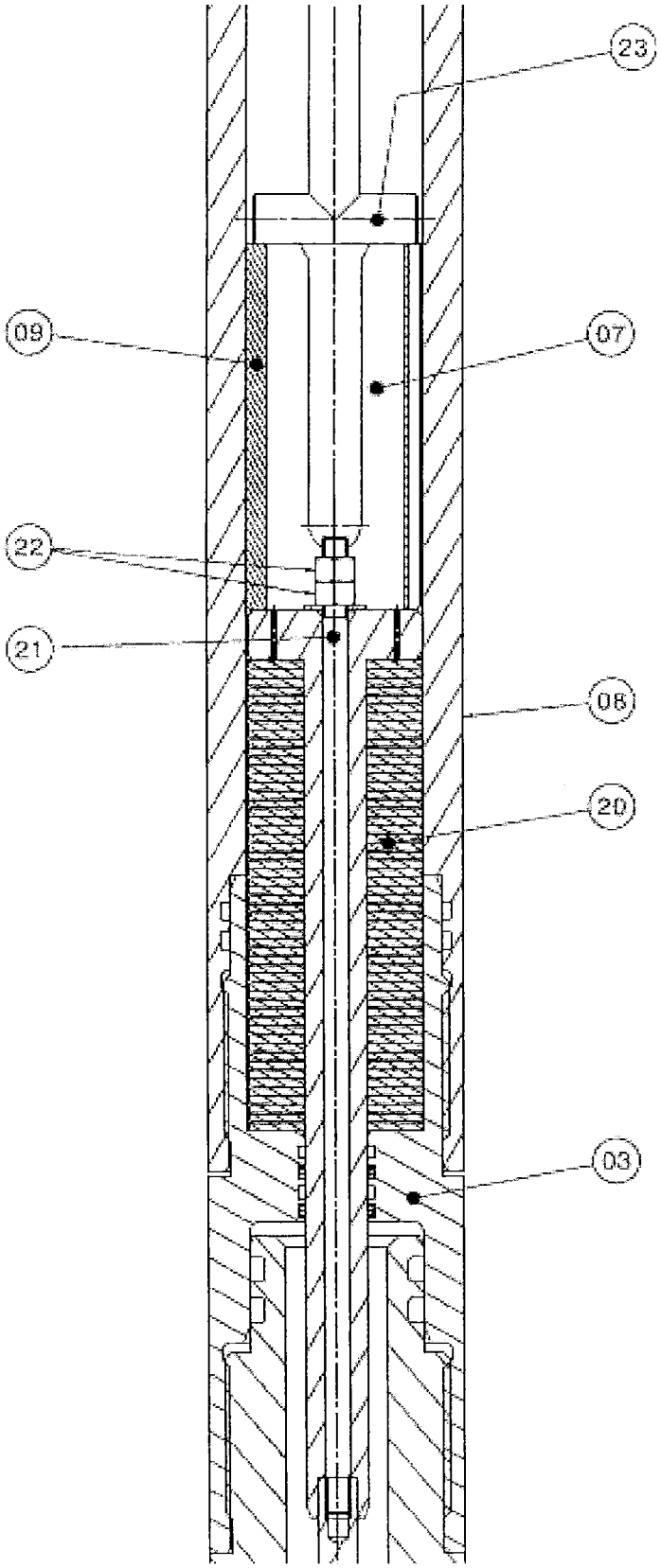
FIG. 4 shows the central part of the device.

FIG. 1 illustrates the device in "open" position. The right-hand figure is a cross-section along axis A-A of the left-hand figure. FIG. 2 shows the lower part of the device. FIG. 3 illustrates the device in "closed" position. The middle figure is a cross-section along axis B-B of the left-hand figure, and the right-hand figure is a cross-section along axis C-C of the middle figure. FIG. 4 shows the central part of the device. Thus, the device according to the invention comprises (FIG. 1) a sample chamber (01). The purpose of this chamber is to receive the fluid under pressure (under downhole conditions). The sample chamber can comprise a shell (01) defining an inner volume intended to receive the fluid. The lower part of chamber (01) can be screwed onto a lower end piece (06) comprising at least one port allowing passage of the fluid. The upper part of chamber (01) is screwed onto a body (10, 03, 08). The chamber also comprises a port in the upper part thereof so as to circulate the fluid within the chamber. The fluid flows in through the lower port of the chamber or through the port of lower end piece (06) and it flows out through the port of the chamber in the upper part thereof.

The body comprises a chamber filled with oil in which an elastic element (20) is immersed. This elastic element can be a spring or a set of Belleville washers. It is connected to a lower piston (05) by a brace (07) and a rod (04).

This piston (05) allows or prevents passage of the fluid under pressure into the lower part of chamber (01). Thus, in the high position, piston (05) is positioned at least partly in chamber (01), at the lower end thereof, tightly closing the inlet thereof (the piston is provided with joints for example). In the low position, the piston moves out of chamber (01), thus allowing the fluid to flow in. When chamber (01) is provided with a lower end piece (06), this end piece (06) has a length allowing lower piston (05) to move out of the chamber and therefore allowing passage of a fluid into sample chamber (01) via the port (28).

Thus, when elastic element (20) is compressed (FIGS. 1 and 2), rod (04) drives (assisted by brace (07)) lower piston (05) out of sample chamber (01) to allow passage of a fluid into the chamber. On the other hand, when elastic element (20) is relaxed (FIGS. 3 and 4), rod (04) drives lower piston (05) upwards to tightly close sample chamber (01) in the lower part thereof.

As illustrated in FIGS. 1 and 2, lower piston (05) can be equipped with a needle valve (25) and a high-pressure connection allowing the fluid to be discharged out of sample chamber (01) when the device has been brought back to the surface and the fluid sample is to be analyzed.

A second piston (02), referred to as upper piston, is positioned in chamber (01), at the upper end thereof when the fluid is not transferred out of the chamber. This upper piston (02) slides in the chamber from one end to the other. It has a central port allowing an upper part of rod (04) to slide and providing a seal with a lower part of rod (04) with the diameter of the lower part of rod (04) being larger than that of the upper part. Thus, when elastic element (20) is relaxed, rod (04) cooperates with upper piston (02) to tightly close the sample chamber (01) in the upper part thereof. Rod (04) is therefore provided with a shoulder that plugs the hole of upper piston (02). This upper piston (02) can be locked by suitable locking screws (27).

The chamber can be closed in the upper part thereof by an element of body (10, 03, 08) referred to as connector tube (10). This connector tube is fastened to an upper tube (08) through another tube (03).

Upper tube (08) comprises elastic element (20) and means (07, 22, 09, 23) for relaxing or compressing it. These means include:

- a support brace (07) for the spring with a bolt (21) and its nuts (22);
- a split collet (09) that releases or locks the spring in compression; and
- a handle (23) that holds the spring compressed.

Figure 5:
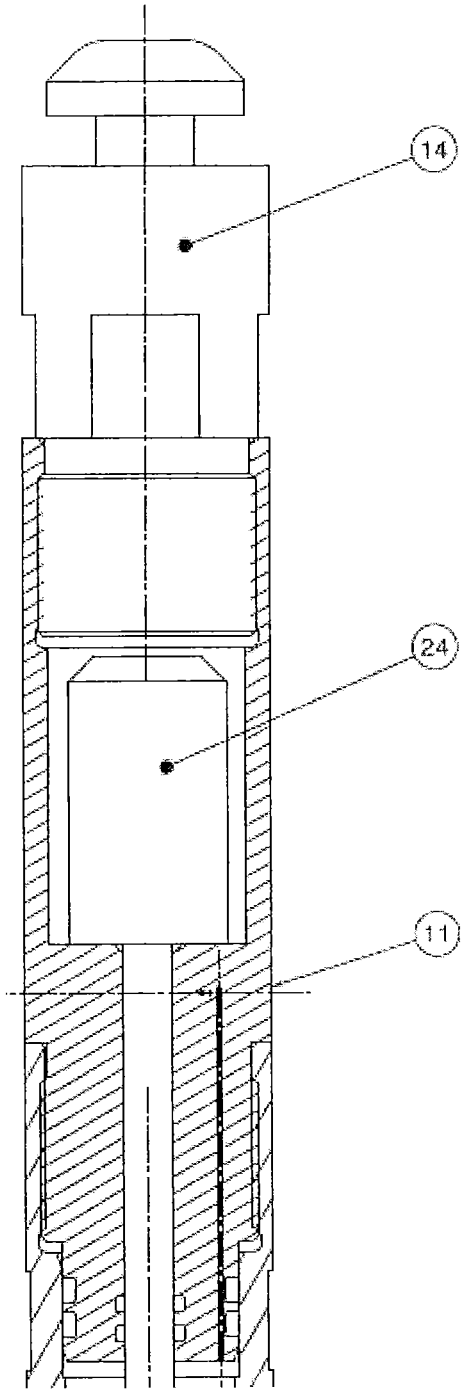
FIG. 5 shows the upper part of the device.

Finally, FIG. 5 shows the upper part of the device. Means (07, 22, 09, 23) for relaxing or compressing the elastic element (20) are connected to an electric motor or to a clock (24). This motor part is arranged in a housing tube (11) fastened to body (10, 03, 08), at the location of the upper tube (08). This motor part is capped by a latching part (14) allowing the device to be fastened to a cable and lowered into a well.

The motor or the clock cooperates with the handle by means of a shaft.

Moreover, housing tube (11) is provided with a needle valve (26) and a high-pressure connection for filling the spring chamber with oil.

Furthermore, the device according to the invention comprises closing assistance means (not shown) allowing discharging part of the sampled fluid during the ascent of lower piston (05) from the chamber (01) so that the fluid does not hinder closure thereof.

Operation of the Device

Figure 6:
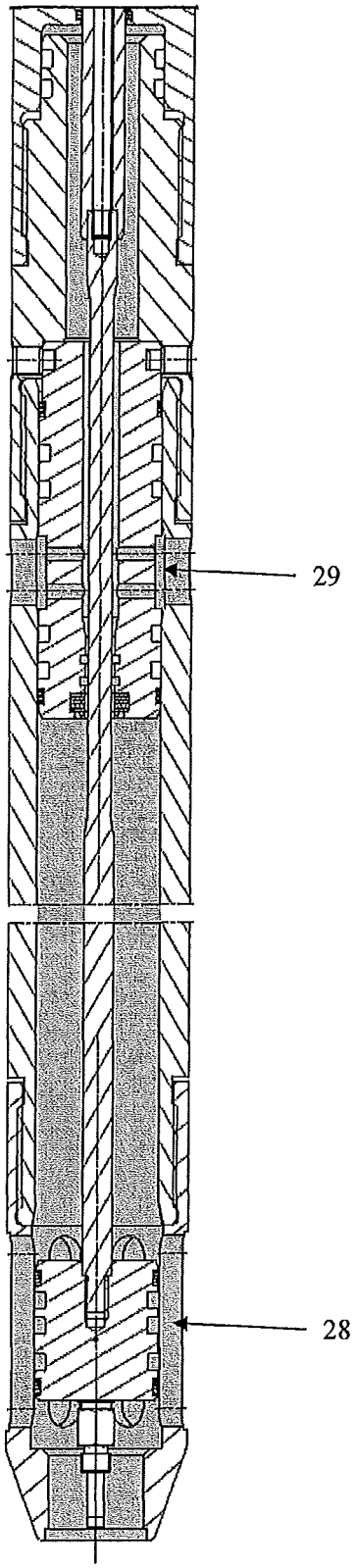
FIG. 6 shows the sampled fluid distribution in the lower part of the device.

Device in "Open" Position (FIGS. 1, 2 and 6)

In open position, the fluid under pressure circulates freely within sample chamber (01). In this position, spring (20) is tightened and kept at a certain compression level (80% for example) by a handle (23) connected to the shaft of the motor (or of the clock).

In this configuration, lower piston (05) is in the low position. The well fluid thus circulates freely through the sample chamber (while the sampler is being lowered into the well for example). In the lower part of the chamber, the fluid flows through the ports (28) of FIG. 6 of end piece (06), then it flows upward in the chamber and between rod (04) and upper piston (02). A series of bores and openings allow the fluid to circulate through the second ports (29) of FIG. 6 (oblong openings) of shell (01). The shaded areas in FIG. 6 show the presence of the fluid.

According to an embodiment, the ports (oblong openings) of chamber (01) and of end piece (06) are equipped with a grid (of 80-μm mesh size for example) for screening the solid particles of the fluid.

Device in "Closed" Position: The Sample Chamber is Locked (FIG. 3)

To start sampling, spring (20) is released. Handle (23) is therefore rotated and, after achieving a quarter turn, it faces the opening of collet (09). Spring (20) is then released and relaxes, thus driving brace (07), rod (04) and lower piston (05). Since the spring chamber is filled with oil, this upward motion occurs smoothly and does not disturb the sampled fluid.

Once the spring is relaxed, the piston (05) is in the lower part of shell (01) and a seal is provided in the lower part of the sample chamber. In the upper part the seal is provided by rod (04) on upper piston (02) through the larger diameter at the base of the rod. The fluid sample is isolated and sealed. The sampler can be taken up to the surface.

To turn the handle, two embodiments are described:

a surface operator actuates electric motor (24) at the appropriate time. This motor rotates handle (23); or an on-board stand-alone clock actuates handle (23) at the programmed date and time.

Figure 7:
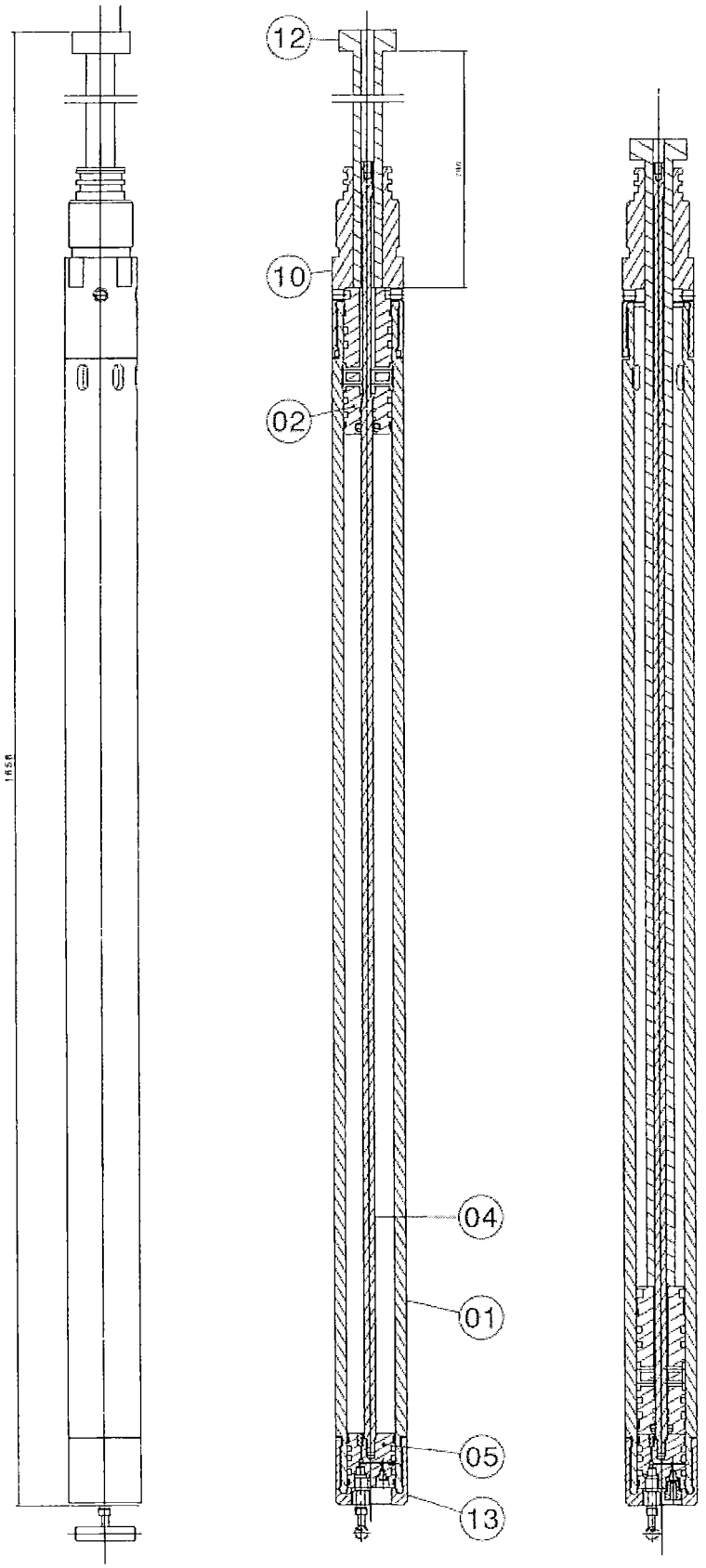
FIG. 7 illustrates the position in "transfer" mode with the middle figure being a cross-section along axis A-A of the left-hand figure with the fluid-filled chamber and the right-hand figure being a cross-section along axis A-A of the left-hand figure with the emptied chamber.

Device in "Transfer" Position (FIG. 7)

FIG. 7 illustrates the position in "transfer" mode. The middle figure is a cross-section along axis A-A of the left-hand figure with the chamber filled with fluid, and the right-hand figure is a cross-section along axis A-A of the left-hand figure with the emptied chamber. Once the device has been raised to the surface, the fluid sample can be transferred. The following stages are therefore required:

unscrewing the end piece (06) and replace with end piece (13) which allows the lower piston (05) to be locked in position within chamber (01);

draining the oil from the spring chamber via needle valve (26) and collecting the oil by connecting to the HP connection;

removing the "motor and hooking" part by unscrewing connector tube (11);

unscrewing tube (8);

removing nuts (22) and unscrew bolt (21);

unscrewing the connector tube (03), then removing it with support brace (07) and spring (20);

engaging the transfer piston (12) until it rests against upper piston (02);

unscrewing lock screws (27);

connecting it to the HP connection of lower piston (05);

applying the transfer motion of piston (12) to upper piston (02) and open needle valve (25); and completing transfer once upper piston (02) rests on lower piston (05).

Figure 8:
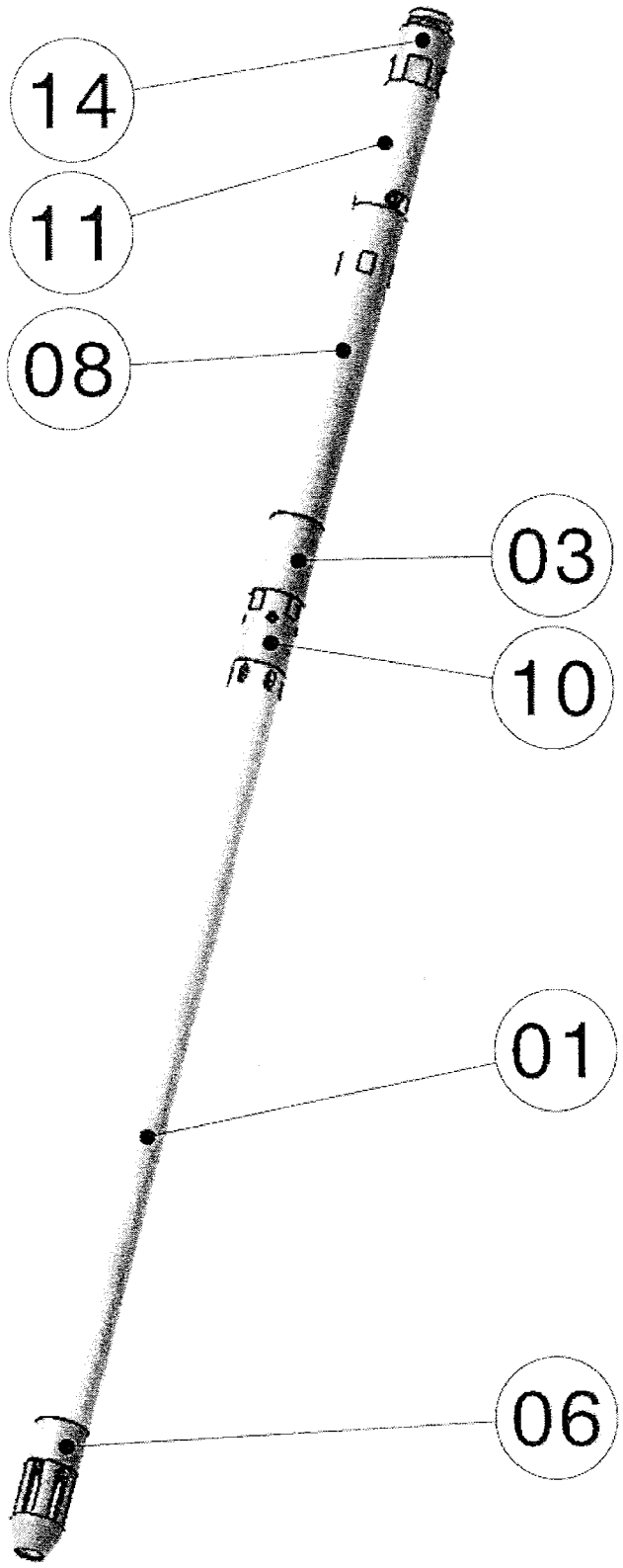
FIGS. 8, 9 and 10 illustrate 3D views of the device.
Figure 9:
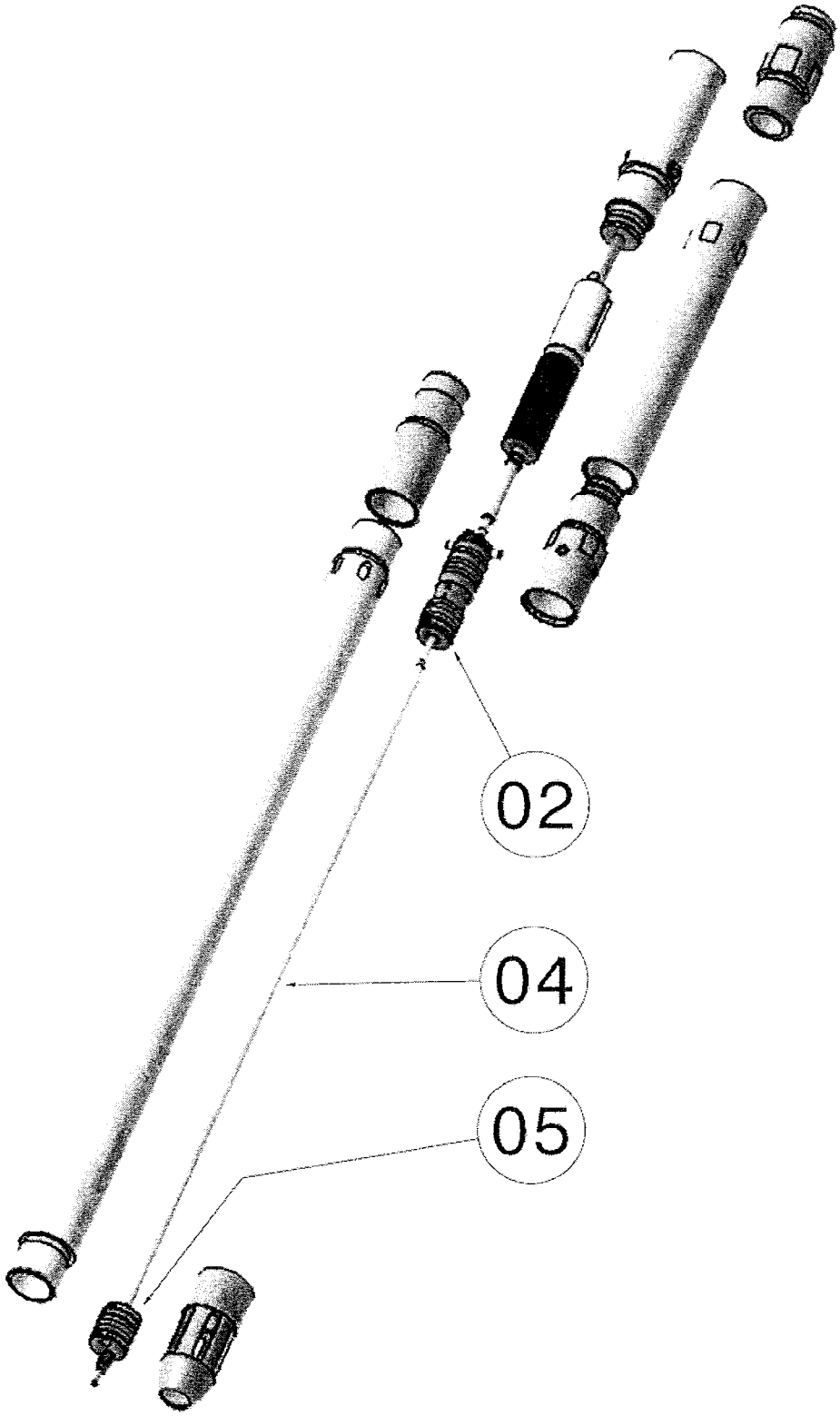
Figure 10:
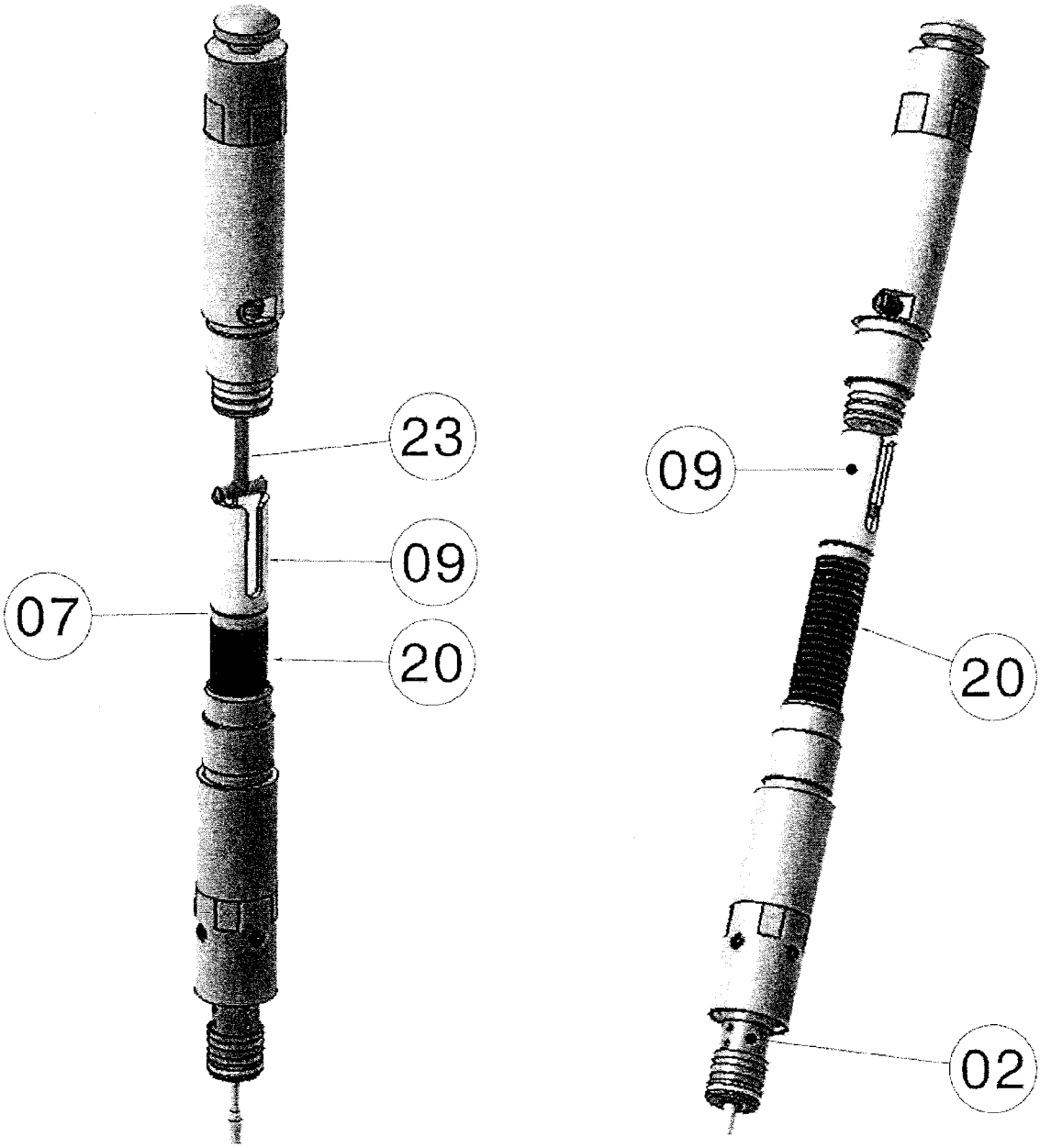

FIGS. 8, 9 and 10 illustrate 3D views of the device.

USE OF THE INVENTION

The invention also relates to a method of monitoring the development of an underground geological site. It can concern:

monitoring a geological $CO_2$ storage site;

monitoring a natural gas storage/withdrawal site;

monitoring a geothermal site; or monitoring a shale gas development site.

Using the device according to the invention for monitoring the development of an underground geological site by sampling fluid under pressure by a monitoring well comprises the following stages:

actuating the handle so as compress the elastic element;

lowering the device, in "open" position, into the monitoring well, by use of a cable fastened to the upper part of the device;

at a predetermined depth, leaving the device in "open" position for a predetermined period of time;

actuating the handle to release the elastic element so that the device is thus brought into "closed" position;

bringing the device back to the surface;

transferring the fluid out of the chamber of the device by pushing the upper piston while controlling the pressure by a pressure detector so that the pressure in the chamber remains constant; and performing analyses of the sampled fluid, such as an analysis of the cationic and anionic aqueous species, analysis of the so-called trace elements, analysis of the dissolved organic and inorganic carbon and analysis of the dissolved gases (main and rare gases).

One advantage of this device is that it can be lowered in open position into the underground medium to avoid opening problems within the underground medium and to allow complete filling of the sample chamber.

All the analyses are interpreted and allow notably determining whether a $CO_2$ leak is present on the storage site and, if so, which type of leak.

To turn the handle, there are two possible embodiments which a surface operator actuates electric motor (24) at the appropriate time which motor rotates handle (23); or an on-board stand-alone clock actuates handle (23) at the programmed date and time.

The invention claimed is:

1. A device for sampling fluid under pressure from a well, comprising:

a sample chamber defining an inner volume for receiving the fluid;

a body disposed above the sample chamber;

means for circulating the fluid through the sample chamber;

means for keeping the fluid in the sample chamber; and means for transferring the fluid out of the sample chamber; wherein the means for keeping comprises a first piston for allowing or preventing a inflow of the fluid into a lower part of sample chamber, the first piston being displaced by an elastic element disposed in a chamber filled with oil; and the means for transferring comprises means for controlling descent of a second piston from an upper part to the lower part of the chamber such that the fluid remains at constant pressure in the sample chamber.

2. A device as claimed in claim 1, wherein the first piston is connected to the elastic element by another element so that when the elastic element is compressed the another element drives the first piston out of sample chamber permitting the fluid to flow into the sample chamber.

3. A device as claimed in claim 1, wherein the first piston is connected to the elastic element by another element so that when the elastic element is relaxed, the another element cooperates with the second piston to close the sample chamber in an upper part thereof and the another element drives the first piston upwards to close the sample chamber in the lower part thereof.

4. A device as claimed claim 2, wherein the another element comprises a rod and a second piston is provided with a central port allowing an upper part of the rod to slide and provides a sealed closing with a lower part of the rod and a diameter of the lower part of the rod is larger than that of an upper part of the rod.

5. A device as claimed claim 3, wherein the another element comprises a rod, the second piston is provided with a central port allowing an upper part of the rod to slide and provides a sealed closing with a lower part of rod and a diameter of the lower part of the rod is larger than that of an upper part of the rod.

6. A device as claimed in claim 1, wherein the sample chamber is closed in the lower part thereof by an end piece provided with at least a first port with an end piece having a length enabling the first piston to pass a fluid into the sample chamber via the first port when the elastic element is compressed.

7. A device as claimed in claim 2, wherein the sample chamber is closed in the lower part thereof by an end piece provided with at least a first port with end piece having a length enabling the first piston to pass a fluid into the sample chamber via the first port when the elastic element is compressed.

8. A device as claimed in claim 3, wherein the sample chamber is closed in the lower part thereof by an end piece provided with at least a first port with end piece having a length enabling the first piston to pass a fluid into the sample chamber via the first port when the elastic element is compressed.

9. A device as claimed in claim 4, wherein the sample chamber is closed in the lower part thereof by an end piece provided with at least a first port with end piece having a length enabling the first piston to pass a fluid into the sample chamber via the first port when the elastic element is compressed.

10. A device as claimed in claim 5, wherein the sample chamber is closed in the lower part thereof by an end piece provided with at least a first port with end piece having a length enabling the first piston to pass a fluid into the sample chamber via the first port when the elastic element is compressed.

11. A device as claimed in claim 1, wherein the means for circulating comprises at least a first port allowing the fluid to flow out from an upper part of the sample chamber and to flow in at least from a second port on an end piece at a lower part of the sample chamber.

12. A device as claimed in claim 2, wherein means for circulating comprises at least a first port allowing the fluid to flow out from an upper part of the sample chamber and to flow in at least from a second port on an end piece at a lower part of the sample chamber.

13. A device as claimed in claim 3, wherein means for circulating comprises at least a first port allowing the fluid to flow out from an upper part of the sample chamber and to flow in at least from a second port on an end piece at a lower part of the sample chamber.

14. A device as claimed in claim 4, wherein means for circulating comprises at least a first port allowing the fluid to flow out from an upper part of the sample chamber and to flow in at least from a second port on an end piece at a lower part of the sample chamber.

15. A device as claimed in claim 6, wherein means for circulating comprises at least a first port allowing the fluid to flow out from an upper part of the sample chamber and to flow in at least from a second port on an end piece at a lower part of the sample chamber.

16. A device as claimed in claim 1, wherein the body comprises at least one tube, the elastic element and means for relaxing or compressing the elastic element.

17. A device as claimed in claim 2, wherein the body comprises at least one tube, the elastic element and means for relaxing or compressing the elastic element.

18. A device as claimed in claim 3, wherein the body comprises at least one tube, the elastic element and means for relaxing or compressing the elastic element.

19. A device as claimed in claim 4, wherein the body comprises at least one tube, the elastic element and means for relaxing or compressing the elastic element.

20. A device as claimed in claim 6, wherein the body comprises at least one tube, the elastic element and means for relaxing or compressing the elastic element.

21. A device as claimed in claim 11, wherein the body comprises at least one tube, the elastic element and means for relaxing or compressing the elastic element.

22. A device as claimed in claim 16, wherein the means for relaxing or compressing the elastic element comprises a split collet which is slidingly mounted in the body and cooperates with a handle for compressing or releasing the elastic element.

23. A device as claimed in claim 16, wherein the means for relaxing or compressing the elastic element is connected to an electric motor or to a clock.

24. A device as claimed in claim 22, wherein the means for relaxing or compressing the elastic element is connected to an electric motor or to a clock.

25. A device as claimed in claim 23, wherein the electric motor or clock is positioned in a tube comprising a needle valve and a pressure connection for filling the chamber of the elastic element with oil.

26. A device as claimed in claim 24, wherein the electric motor or clock is positioned in a tube comprising a needle valve and a pressure connection for filling the chamber of the elastic element with oil.

27. A device as claimed in claim 1, wherein the elastic element comprises a spring or a set of Belleville washers.

28. A device as claimed in claim 2, comprising a transfer piston mounted for pushing the second piston, wherein the transfer piston is hollow and a rod slides therein.

29. A device as claimed in claim 3, comprising a transfer piston mounted for pushing the second piston, wherein the transfer piston is hollow and a rod slides therein.

30. A device as claimed in claim 4, comprising a transfer piston mounted for pushing the second piston, wherein the transfer piston is hollow and a rod slides therein.

31. A device as claimed in claim 6, wherein the end piece is removable from the sample chamber and is replaceable by an end piece without a port while retaining the first piston within the sample chamber.

32. A device as claimed in claim 1, wherein the first piston includes a needle valve and a pressure connection allowing the fluid to be discharged from the sample chamber.

33. A method of use of the device as claimed in claim 1, wherein a development of an underground geological site is monitored by sampling fluid under pressure with a monitoring well comprising:

compressing the elastic element;

lowering the device, in open position, into the monitoring well, using a cable attached to an upper part of the device;

at a predetermined depth, leaving the device in the open position for a predetermined period of time to receive fluid;

releasing the elastic element to cause the device to switch into closed position to retain the fluid under pressure;

bringing the device back to the surface;

transferring the fluid out of the chamber of the device by pushing the second piston while controlling the pressure to maintain pressure in the sample chamber constant; and performing analyses of the sampled fluid.

34. A method as claimed in claim 33, wherein development of an underground geological site monitors one of a geological $CO_2$ storage site, a natural gas storage, a natural gas withdrawal site, or a shale gas development site.

* * * * *